US005687661A

United States Patent [19]

Menzin et al.

[11] Patent Number: 5,687,661

[45] Date of Patent: *Nov. 18, 1997

[54] FABRIC PIECE CONVEYING SYSTEM

[75] Inventors: Marvin Menzin, Lexington; Donald E. Burt, Danvers; Henry R. Cofek, Groton, all of Mass.

[73] Assignee: Design Technology Corporation, Billerica, Mass.

[ * ] Notice: The term of this patent shall not extend beyond the expiration date of Pat. No. 5,568,780.

[21] Appl. No.: 183,732

[22] Filed: Jan. 19, 1994

[51] Int. Cl.[6] ..... D05B 39/00

[52] U.S. Cl. ..... 112/470.18; 112/306; 112/311; 112/470.36

[58] Field of Search ..... 112/102–104, 117–119, 112/121.15, 304, 2.1, 306, 311, 470.18, 470.36

[56] References Cited

U.S. PATENT DOCUMENTS

| | | | |
|---|---|---|---|
| 2,869,492 | 1/1959 | Seavert | 112/2.1 |
| 4,155,317 | 5/1979 | Enomoto | 112/2.1 X |
| 4,558,653 | 12/1985 | Horton et al. | 112/121.15 X |
| 4,905,615 | 3/1990 | Pofferi | 112/2.1 |
| 4,996,931 | 3/1991 | Mall | 112/121.15 X |
| 5,016,549 | 5/1991 | Sadlack et al. | 112/121.15 X |
| 5,040,473 | 8/1991 | Zech et al. | 112/117 |
| 5,182,998 | 2/1993 | Iwase | 112/117 |
| 5,218,915 | 6/1993 | Iwasaki et al. | 112/121.15 X |
| 5,237,943 | 8/1993 | Klein et al. | 112/121.15 X |
| 5,272,994 | 12/1993 | Scholl et al. | 112/121.15 |

*Primary Examiner*—Ismael Izaguirre

*Attorney, Agent, or Firm*—Rhodes Coats & Bennet, L.L.P.

[57] ABSTRACT

A binding conveyor system for applying binding to a fabric piece. The apparatus includes an unique binding fixture for holding the fabric piece. The fixture includes: a base; a support attached to the base; and fabric engaging device mounted on the support for engaging, positioning and securing the fabric piece. A conveyor transports the binding fixture to at least one work station for operating on the fabric piece while the same is being held by the binding fixture. A transfer station places the fabric piece on the binding fixture.

102 Claims, 7 Drawing Sheets

FABRIC PIECE CONVEYING SYSTEM

BACKGROUND OF THE INVENTION

1. Field of the Invention

The present invention relates generally to a combining conveyor system for assembling fabric pieces, and more particularly, to a combining conveyor system for fabric having a unique binding fixture.

2. Description of the Prior Art

The manufacture of textile clothing articles such as briefs, tee-shirts and outer garments has resisted automation. This is due largely because of the difficulty in accurately positioning so called "soft" materials. For example, the knitted material commonly used in briefs and tee-shirts may wrinkle, stick to one another and stretch significantly when handled.

One technique which has been somewhat successful has been the introduction of fiber optic edge detectors. Such detectors, when attached to a sewing machine and guide means can allow some automation of common sewing operations such as binding an edge of a precut fabric piece. However, such operations still require the use of a skilled operator to feed the fabric piece to the sewing machine and usually carry out only one sewing operation at a time.

Thus, there remains a need for a binding conveyor system for assembling fabric pieces for manufacturing fabric assemblies for a men's brief or the like which can be carried out completely automatically without the need for a skilled operator.

SUMMARY OF THE INVENTION

The present invention is directed to a binding conveyor system which applies binding to a fabric piece. The apparatus includes an unique binding fixture for holding the fabric piece. The fixture includes: a base; a support attached to the base; and fabric engaging means mounted on the support for engaging, positioning and securing the fabric piece. A conveyor transports the binding fixture to at least one work station for operating on the fabric piece while the same is being held by the binding fixture. A transfer station places the fabric piece on the binding fixture.

Accordingly, one aspect of the present invention is to provide a binding conveyor system for applying binding to a fabric piece. The apparatus includes: (a) a binding fixture for holding the fabric piece; (b) a conveyor for transporting the binding fixture; and (c) at least one work station for operating on the fabric piece while the same is being held by the binding fixture.

Another aspect of the present invention is to provide a binding fixture for applying binding to a fabric piece. The fixture includes: (a) a base; (b) a support attached to the base; and (c) fabric engaging means mounted on the support for engaging, positioning and securing the fabric piece.

Still another aspect of the present invention is to provide a binding conveyor system for applying binding to a fabric piece. The apparatus includes: (a) a binding fixture for holding the fabric piece, the fixture including: (i) a base; (ii) a support attached to the base; and (iii) fabric engaging means mounted on the support for engaging, positioning and securing the fabric piece; (b) a conveyor for transporting the binding fixture; (c) at least one work station for operating on the fabric piece while the same is being held by the binding fixture; and (d) a transfer station for placing the fabric piece on the binding fixture.

These and other aspects of the present invention will become apparent to those skilled in the art after a reading of the following description of the preferred embodiment when considered with the drawings.

DESCRIPTION OF THE PREFERRED EMBODIMENTS

Figure 1:
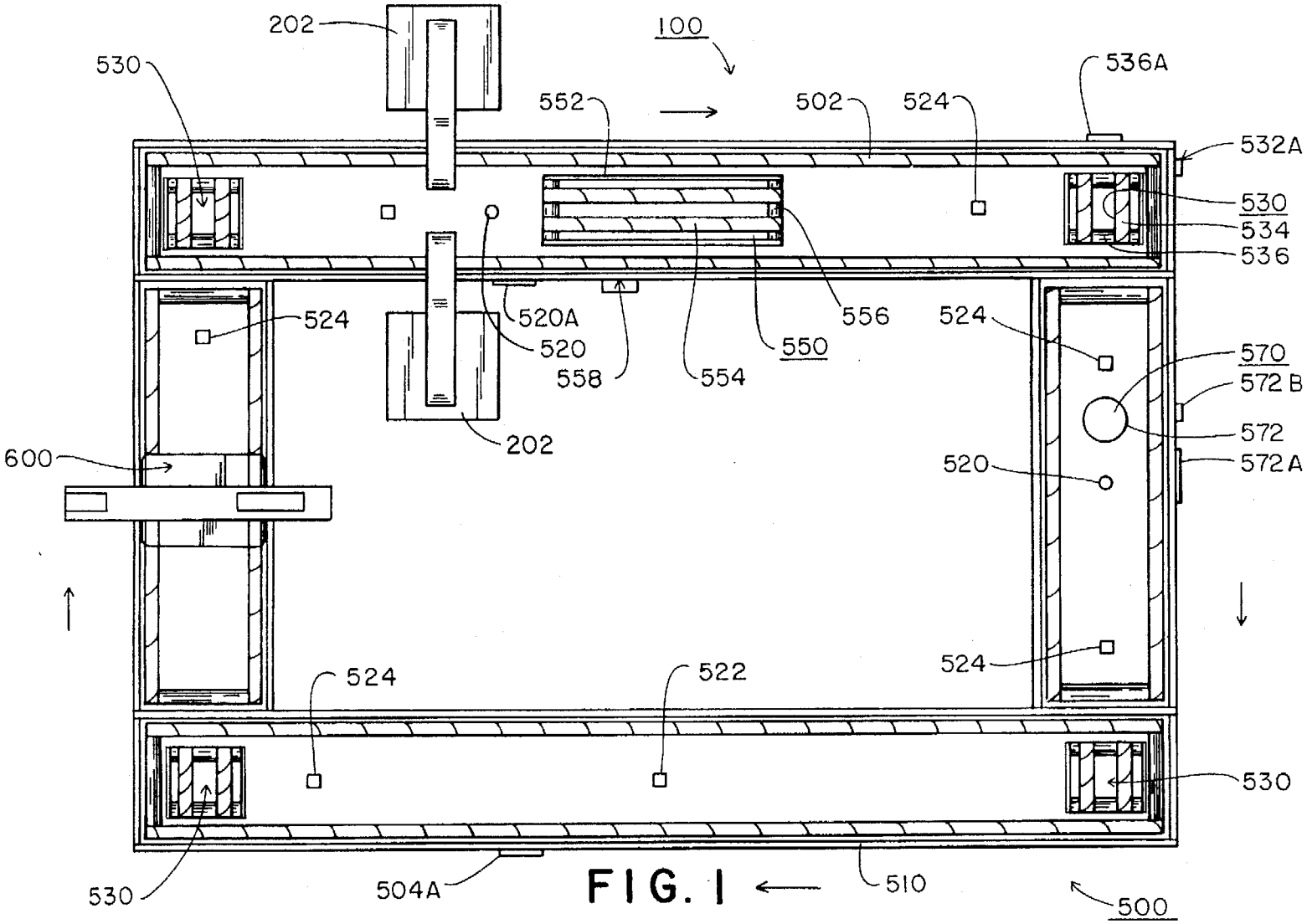
FIG. 1 is a plan view of a binding conveyor system constructed according to the present invention.

In the following description, like reference characters designate like or corresponding parts throughout the several views. Also in the following description, it is to be understood that such terms as "forward", "rearward", "left", "right", "upwardly", "downwardly", and the like are words of convenience and are not to be construed as limiting terms.

The present invention provides for automatic handling of fabric garments. While the following description of the preferred embodiment only discloses the operation of applying binding to garments, it will be understood that a multiplicity and variety of operations could be performed on garments using the system of the present invention. In describing the preferred embodiment, the process for manufacturing men's briefs underwear will be discussed. However, many similar garment applications will be obvious to those skilled in the art.

As best seen in FIG. 1, the apparatus of the present invention includes two basic sub-systems: a conveyor generally denoted by the numeral 500 and a binding fixture generally denoted by the numeral 600. Also forming a part of the invention is binding machine 202. While only this single work station is shown, the system of the present invention can easily be designed to accommodate many work stations.

Basic operation of the present invention is as follows. Fixture 600 rides along conveyor 500. Work stations such as binding machine 202 are located along the path of conveyor 500. As a garment mounted on fixture 600 passes by a work station, it is operated upon. Several features are provided to facilitate the flow of the fixture and the accuracy and efficiency of the operations including lift systems 530, rotators 570, stops 520, secondary conveyors 550, and sensor means 522 and 524. It is particularly noteworthy that a plurality of fixtures can be used at once, and therefore a plurality of garments can be fabricated simultaneously.

Conveyor 500 has frame 510. Mounted on frame 510 are primary belts 502 which ride on a fluorocarbon plastic surface and are driven by primary drive means 504A. These drive means may be servo-controlled or conventional motors, for example, depending on the degree of control needed for the associated operations. Fixture 600, which will be discussed more fully later, has base 602 adapted to ride on conveyor 500 and is guided by frame 510. In operation, fixture 600 travels in a clockwise direction. Lift systems 530 are provided to allow fixture 600 to pass around the corners of conveyor 500 without interference with frame 510.

Lift systems 530 have lift belts 534 which travel on lift rollers 536 and are driven by lift motors 536A. Lift systems 530 also have lift supports which support the aforementioned lift system components and are operatively connected to pneumatic cylinders or motors 532A. When fixture 600 is positioned over a lift system 530, the cylinder or motor is actuated such that the lift support raises and meets the base of fixture 600. Driven lift belts 534 engage fixture 600 and push or pull (depending on whether the lift system is located at the entrance or the exit of the corner) fixture 600 over frame 510 and onto the adjacent primary belts 502. Position sensors 524 sense the presence of fixture 600 and can thereby provide associated software with the data necessary to determine when fixture 600 is in position to raise lift support 532.

Rotator 570 operates much like lift system 530. Position sensor 524 signals the position of fixture 600. Rotator support 572 is raised by a pneumatic cylinder 572B and rotated by a pneumatic actuator 572A. Depending on the desired position of fixture 600 for the next operation, fixture 600 may be rotated 90° or 180°.

When multiple fixtures are used or where speed sensitive operations are implemented, it will be advantageous to control the speed of each fixture. Stops 520 are provided to stop a fixture when desired. Stops 520 are actuated by a pneumatic cylinder 520A in the preferred embodiment and engage stop locator 612 formed in base 602 of fixture 600. Stops 520 can then be retracted to allow fixture 600 to resume travel. Secondary conveyors 550 are provided to either speed up or slow down fixtures on various portions of conveyor 500.

Secondary belts 554 are driven by drive means 558 and ride on rollers 556 which are in turn mounted on secondary lift 552. A fixture traveling over a secondary lift is raised off the primary belts and as a result travels at the speed of the secondary belts. This is helpful to ensure a steady and appropriate speed at any given work station during operation, such as a binding machine.

Turning now to binding fixture 600, the same is shown in detail in FIGS. 2–5 and 7. Fixture 600 has base 602.

Stop locators 612 are formed in base 602. Platform 604 is formed on top of base 602.

Bumpers 610 are mounted on base 602 to protect fixture 600 in case of collisions with other fixtures. An identification badge 620 is affixed to the bottom of base 602 to provide information about the fixture and its associated garment to a scanning device. Identification badge 620 may be a bar code or an electrically encoded tab, for example. Sensor means 522 located on conveyor 500 are designed to read whatever information has been encoded on the identification badge (for example, the size of the brief on the fixture).

Front assembly 630 and rear assembly 633 are supported by platform 604. In the preferred embodiment, front post 606 is fixedly mounted to platform 604 and rear post 608 is slidably mounted in track 683 which is formed in platform 604. Rear post 608 and rear assembly 633 may be locked in position by engaging lock teeth 685. Depressing lock release rod 684 will cause lock teeth 685 to disengage so that rear assembly 633 can be slidably readjusted. The importance of this adjustment mechanism will become apparent hereinafter.

Lower legs 654 are pivotally mounted to front and rear posts 606,608 at lower assembly pivots 650A. Lower clamp arms 650 are also pivotally mounted at lower assembly pivots 650A and are biased against lower legs 654 by springs. Lower clamp arms 650 may be pivoted away from lower legs 654 to achieve an open position by pushing lower clamp control levers 662 toward the center of platform 604. Slots 660 are formed in lower legs 654 and lower clamp arms 650 as shown.

Upper legs 656 are pivotally mounted to lower legs 654 at pivot points 670. Upper clamp arms 652 are pivotally mounted to upper legs 656 at pivot points 652A and are biased against upper legs 656 by magnets 690. Upper clamp arms 652 may be separated from upper legs 656 to achieve an open position by rotating actuator engagement slot 653.

Figure 2:
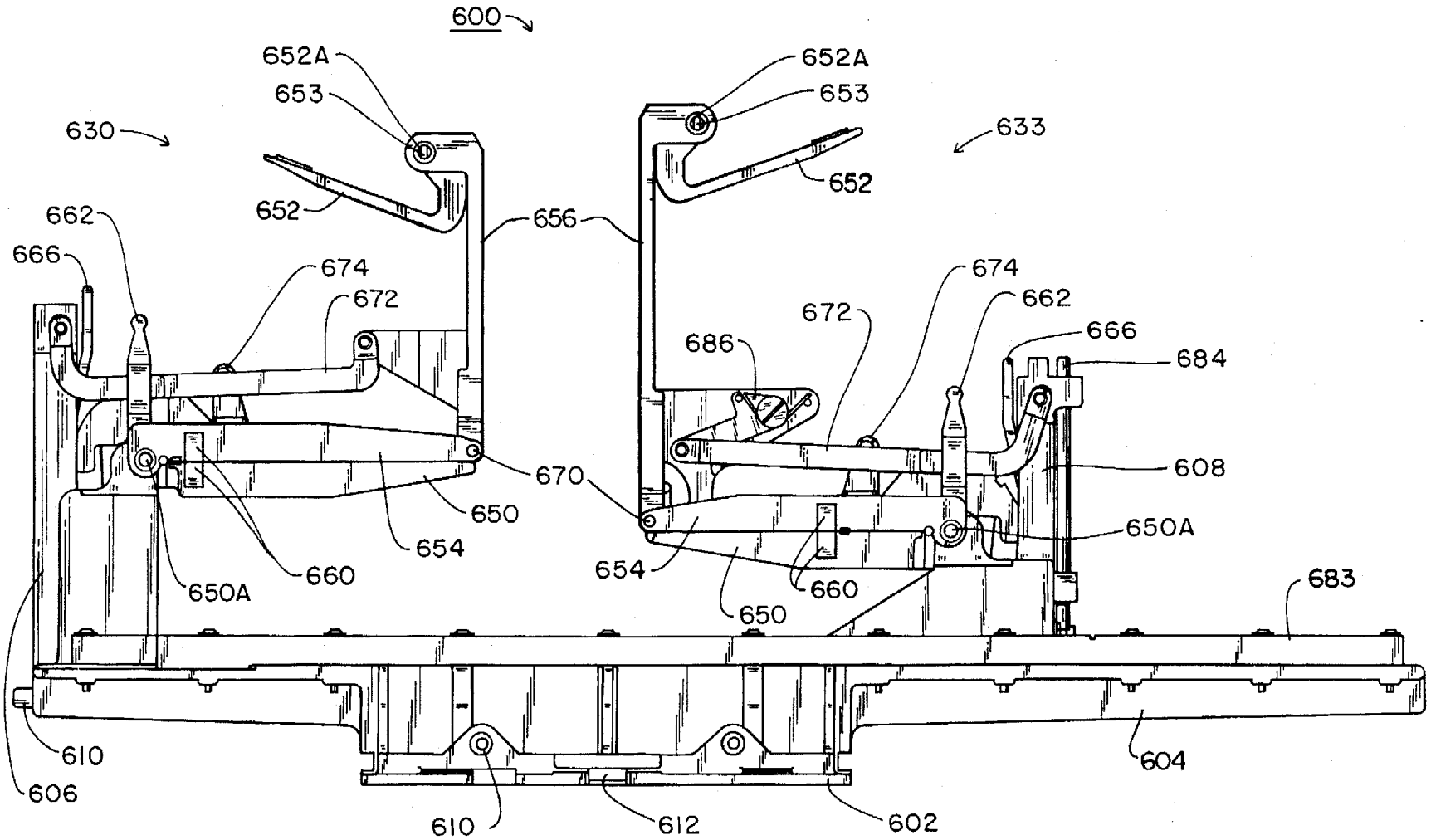
FIG. 2 is a side elevational view of a binding fixture of the present invention in the ready position.
Figure 3:
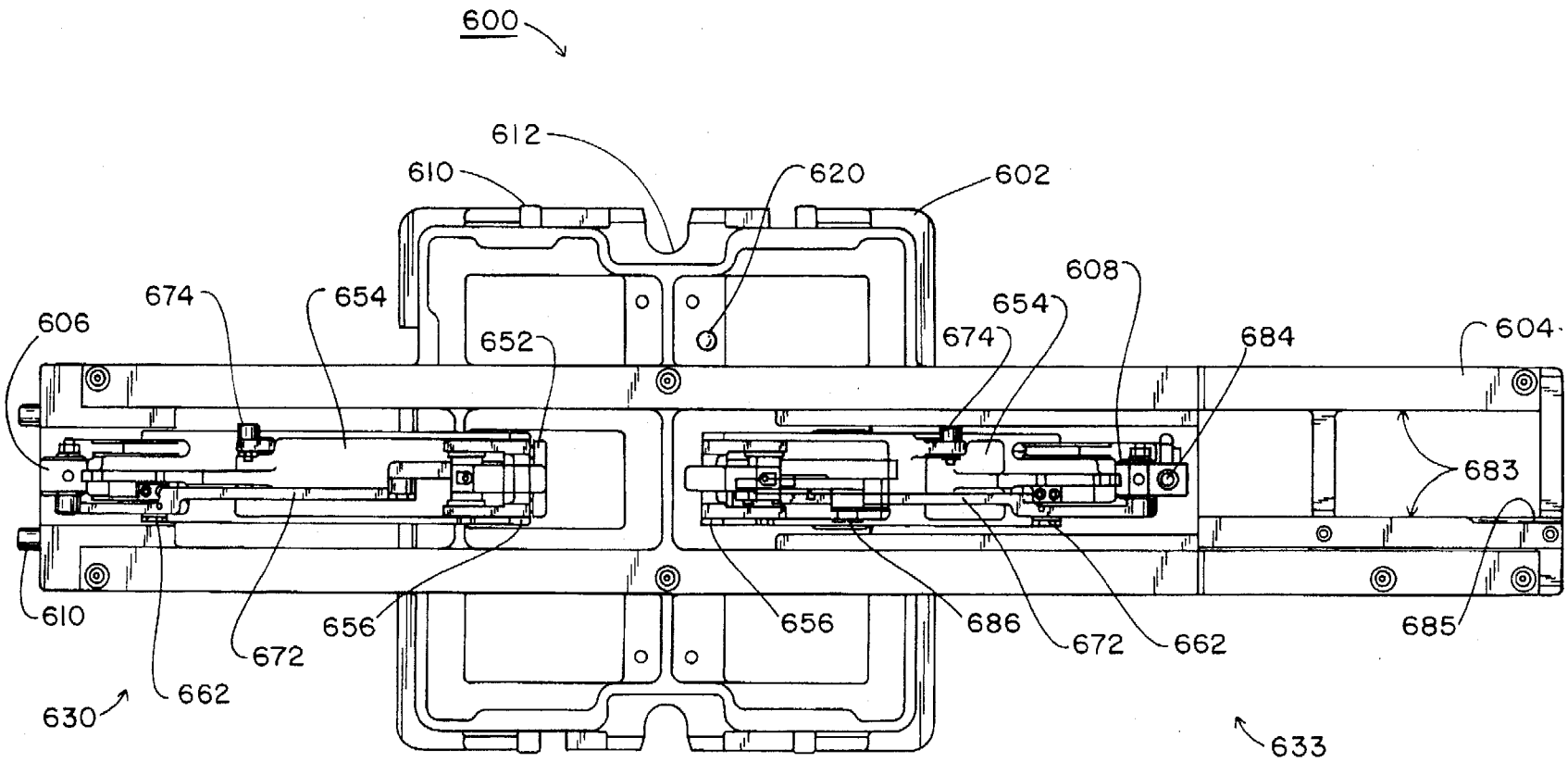
FIG. 3 is a top plan view of the binding fixture forming a part of the present invention in the ready position.
Figure 4:
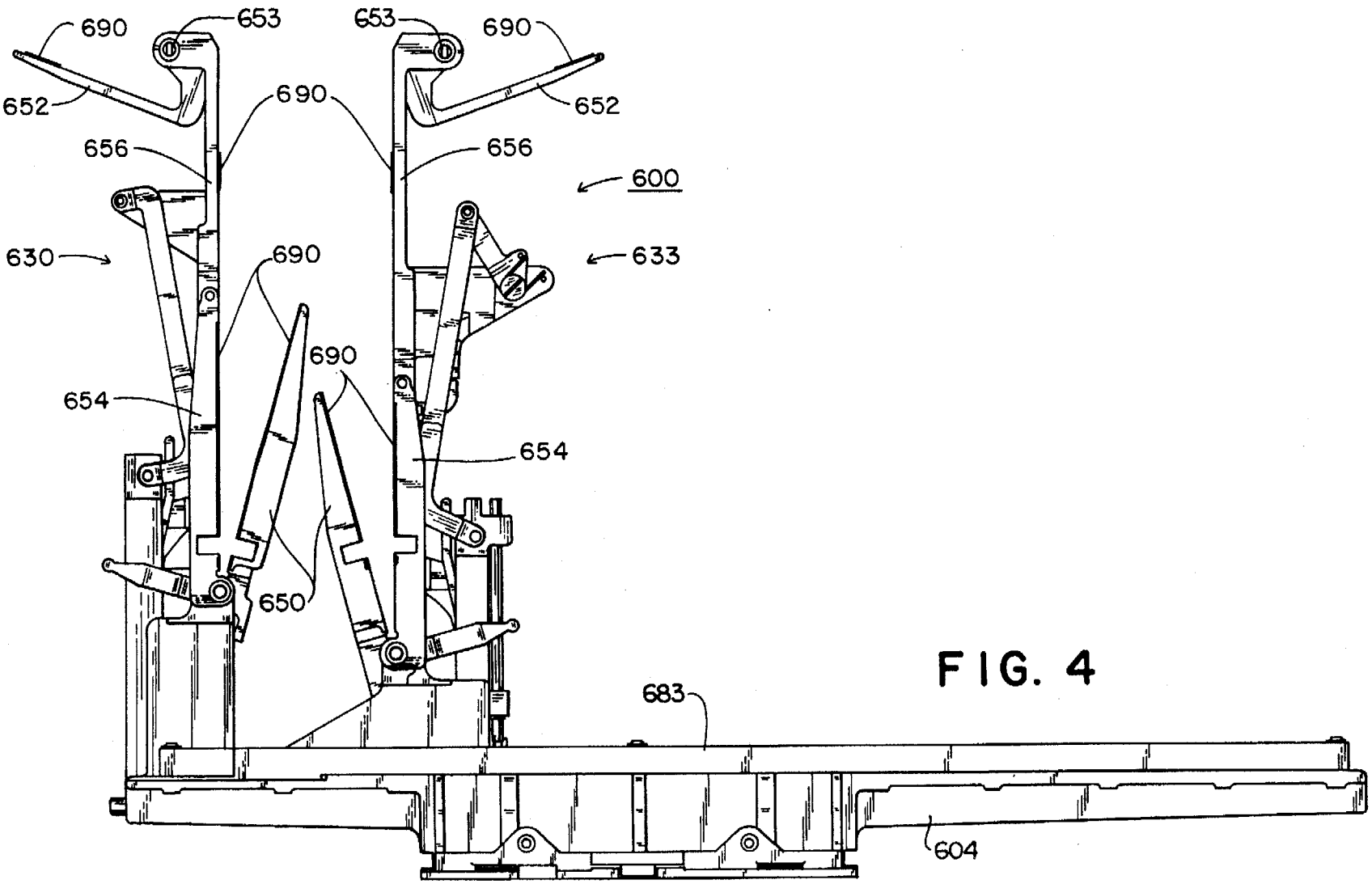
FIG. 4 is a side elevational view of the binding fixture forming a part of the present invention in the receiving position.
Figure 5:
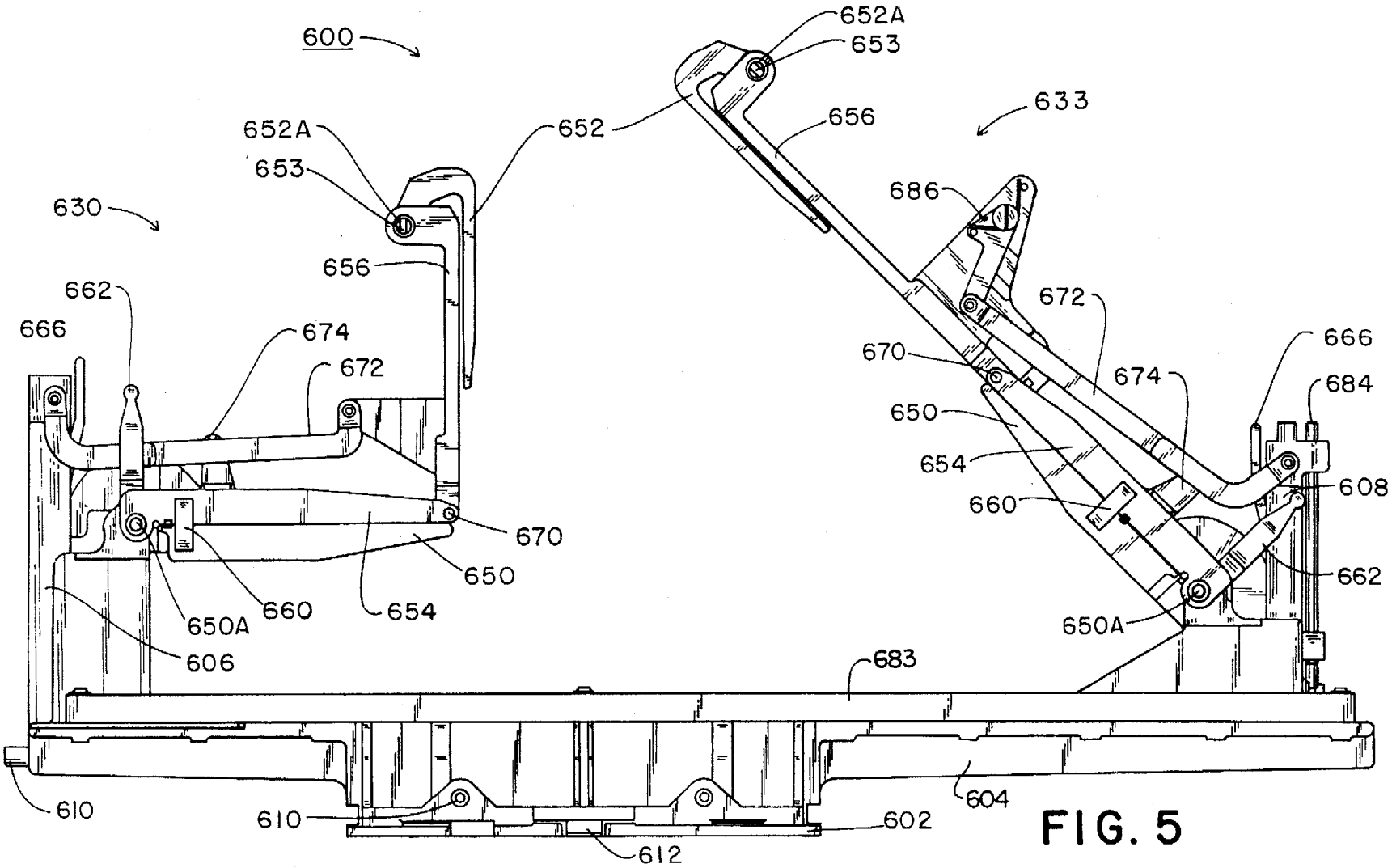
FIG. 5 is a side elevational view of the binding fixture of the present invention in the binding position.
Figure 6:
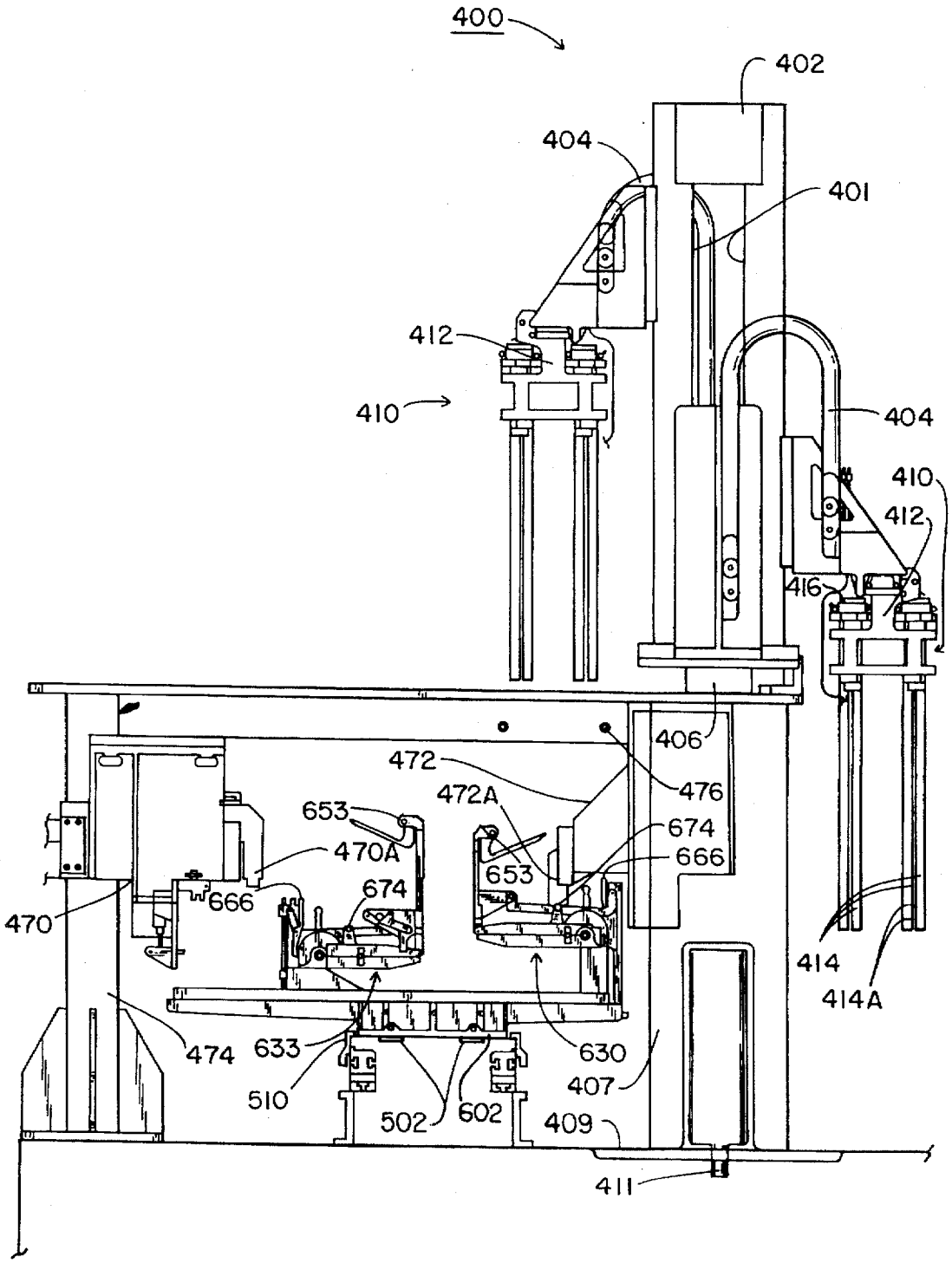
FIG. 6 is a side elevational view of a transfer station which forms a part of the present invention.
Figure 7:
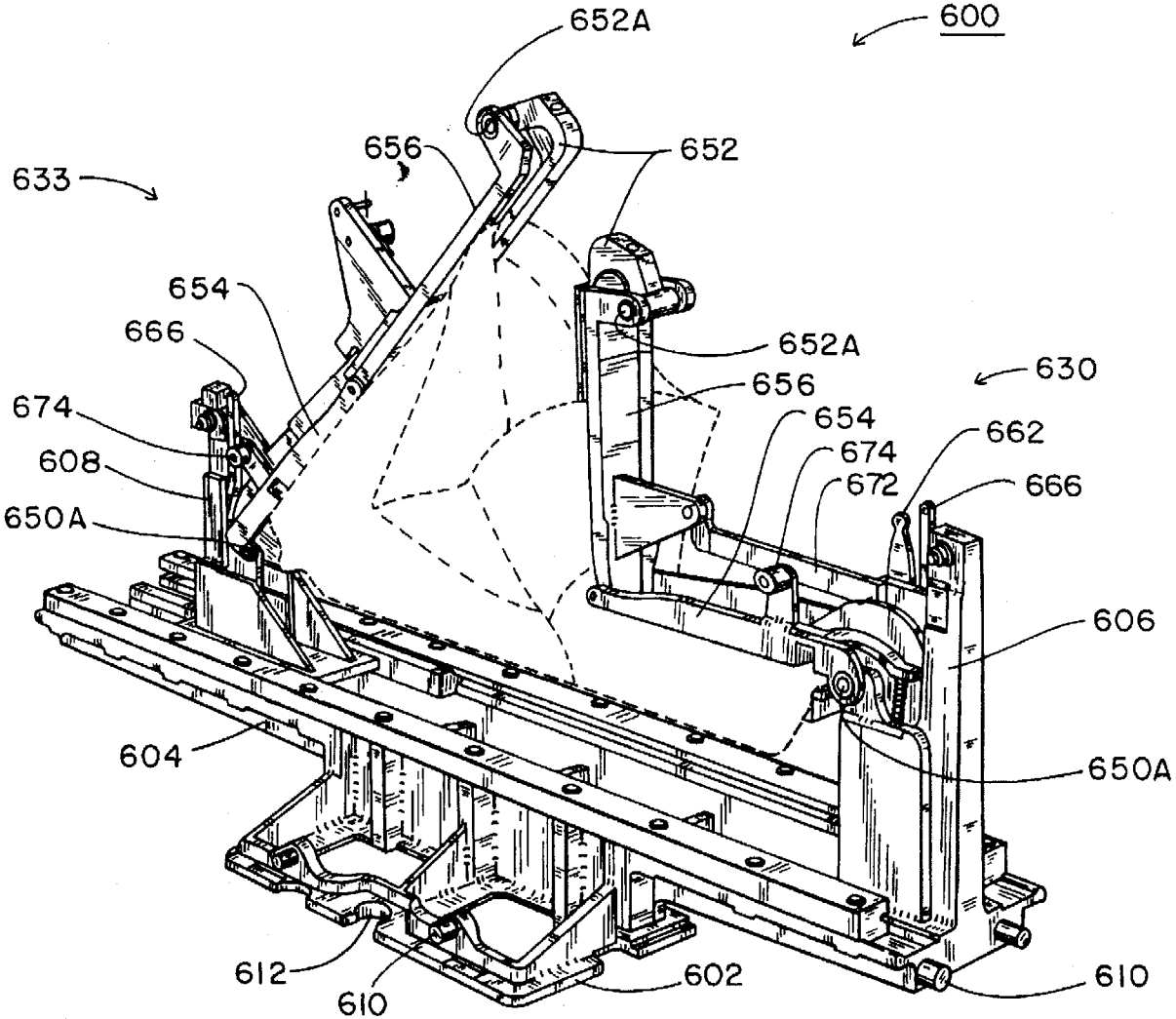
FIG. 7 is a perspective view of the binding fixture of the present invention holding a brief, shown in dotted line form.

Front and rear assemblies 630,633 are interconnected by linkages 672. In the preferred embodiment, a latch, not shown, locks the assemblies in the ready position shown in FIG. 2. Pushing release levers 666 disengages the latches. Assembly control means 674 is operatively connected to linkages 672 such that forcing the end of assembly control means 674 towards or away from the center of platform 604 will cause front and rear assemblies 630,633 to assume the positions shown in FIGS. 4 and 5. These positions will be more fully discussed hereinafter and are referred to as follows:

a. FIGS. 2 and 3 show the "ready" position, b. FIG. 4 shows the "receiving" position, c. FIGS. 5 and 7 show the "binding" position.

Tensioner spring assembly 686 biases the assemblies to remain in the binding position once they have been so disposed by actuating assembly control means 674.

The ready position is shown in FIGS. 2 and 3. In this position, upper clamp arms 652 are open and lower clamp arms 650 are in the closed position. Lower legs 654 are positioned at right angles to front and rear posts 606,608. Upper legs 656 are positioned at right angles to lower legs 654. Rear assembly 633 is positioned near the center of platform 604.

The receiving position is shown in FIG. 4. Upper and lower legs 654,656 are aligned and positioned vertically. Upper clamp arms 652 and lower clamp arms 650 are open. Rear assembly 633 is on the front end of platform 604.

The binding position is shown in FIGS. 5 and 7. In FIG. 7, the binding fixture is shown holding a brief (shown in dotted line form). Front assembly 630 is positioned the same as in the ready position. Rear assembly 633 is positioned somewhat rearward of platform 604 relative to its position in the ready position. The exact location will depend on the size of the brief to be held. Upper and lower legs 656, 654 are aligned and positioned at approximately 45° angles to platform 604. Upper and lower clamp arms 652, 650 are in the closed position.

The three positions of binding fixture 600 can best be understood in relation to the transfer station, generally denoted 400, forming a part of the present invention. In the preferred embodiment, the basic purpose of the transfer station when used to fabricate briefs is to place a garment comprising a combined front brief panel and back brief panel onto fixture 600 such that the critical edges are continuously located and accurately positioned.

Transfer station 400 has mast 402. Mast 402 is mounted by rotational pivot 406 onto base 407, which is in turn fixedly mounted onto table 409. Rotator motor 411 is operatively connected to turn mast 402. Lift assemblies, denoted generally 410, are mounted on mast 402 by braces 404. Braces 404 are vertically slidable along track 401 formed in mast 402.

Lift assemblies 410 have carriages 412 formed thereon. Eight clamp arms 414 depend from each of carriages 412 in four sets of opposed pairs. Each clamp arm 414 has foam backing 414A located on the surface facing its opposing clamp arm 414. Clamp arm actuator means 416 mounted on carriages 412 are operatively connected to clamp arms 412 and are designed to move the same between an open position and a closed position. In the closed position, the foam backing 414A on each clamp arm 414 is pressed against the foam backing of the opposing clamp arm 414. In the open position, the clamp arms are separated.

A fabric brief (combined front and back panels) is transferred from clamp arms 414 to binding fixture 600 as follows. Note that the garment is generally tubular because the crotch seam has not yet been sewn. One end, hereinafter referred to as the top end, is basically circular. The opposite end, hereinafter referred to as the bottom end, has two arcuate cut-outs representing the leg holes of a completed brief.

Clamp arms 414 are initially positioned such that each pair of opposed clamp arms has one clamp arm on the exterior circumference of the brief and one clamp arm on the interior circumference of the brief. The clamp arms are in the closed position so that each of the four sets of the clamp arms 414 is gripping the brief on a separate point along its circumference and fully along its length, with the top end of the brief nearest the carriage and the free ends of the clamp arms extending out of the bottom end of the brief.

Lift assembly 414 is initially disposed on the side of mast 402 opposite binding conveyor 500. Lift assembly 410 and the brief it is holding are transferred to the opposite side of mast 402 by rotating mast 402 at rotational pivot 406. Lift assembly 410 is then lowered vertically by powering brace 404 down track 401.

Binding fixture 600 is initially in the ready position. When conveyor 500 positions fixture 600 in front of transfer station 400, stop 520 raises and holds the fixture in place. Next, rear assembly positioning means 470 and front assembly positioning means 472 slide outwardly from support 474 and base 407, respectively, to engage fixture 600.

Rear assembly positioning means 470 engages lock release 684 and pushes rear assembly 633 along tracks 683 in the direction of mast 402. At the same time, rear assembly positioning means 470 engages release lever 666 and U-shaped slot 470A engages assembly control means 674. Simultaneously and in coordination, U-shaped slot 472A of front assembly positioning means 472 engages and pushes assembly control means 674 of front assembly 630. As assembly control means 674 are pushed forward or rearward by U-shaped slots 470A,472A, linkages 672 cause upper and lower legs 654,656 to assume the receiving position. Rear and front assembly position means 470,472 then force lower clamp control levers 662 upward causing lower clamp arms 650 to open. Clamp actuator means 476 then engage actuator engagement slots 653 of upper clamp pivots 652A and rotate the same.

Upon completion of the above steps, fixture 600 is positioned beneath carriage 412 in the receiving position. Carriage 412 is then lowered vertically down track 401 until assemblies 633,630 are flanked by two sets of clamp arms 414 on each side and the top edge of the brief, still held by clamp arms 414, is approximately level with the top ends of upper legs 656. The crotch portions of the brief (that is, the fabric strips between the leg cut-outs) are disposed between lower legs 654 and lower clamp arms 650.

Next, lower clamp control levers 662 are released by assembly positioning means 470,472 and upper clamp pivots 652A are rotated by clamp actuator means 476. As a result, the brief is captured securely by the upper and lower clamps of fixture 600. Clamp arms 414 of the transfer station are then opened and carriage 412 is raised.

Rear assembly positioning means 470 then forces rear assembly 633 of fixture 600 into the binding position via U-shaped slot 670A. Assembly positioning means 470,472 are then retracted. Fixture 600 remains in the binding position due to tensioner spring assembly 686 and latch 666.

The brief is now held such that the leg cut-outs are held straight, as shown in FIG. 7. In this position, all of the critical edges for binding are accurately located, firmly secured and held such that binding can be applied to the leg holes using a conventional binding apparatus. Once the binding has been applied, the brief can be removed by returning fixture 600 to a ready position, opening the upper and lower clamps, and pulling the brief out of the fixture. This may be done manually or robotically.

Certain modifications and improvements will occur to those skilled in the art upon a reading of the foregoing description. It should be understood that all such modifications and improvements have been deleted herein for the sake of conciseness and readability but are properly within the scope of the following claims.

We claim:

1. A fabric piece conveying system for applying a binding to an edge of a fabric piece, said apparatus comprising:

(a) a fabric piece fixture for holding said fabric piece;

(b) a conveyor for transporting said fabric piece fixture;

(c) at least one stationary work station having a supply of binding located adjacent to said conveyor for attaching said binding to said edge of said fabric piece while said fabric piece is being held by said fabric piece fixture; and (d) a transfer station for placing said fabric piece on said fabric piece fixture, wherein said transfer station includes transport means for transporting said fabric piece and holding means for holding said fabric piece, wherein said holding means is attached to said transport means.

2. The fabric piece conveying system of claim 1 wherein said transport means includes a housing fixture attached to said holding means and a housing fixture actuator for moving said housing fixture.

3. The fabric piece conveying system of claim 2 wherein said housing actuator is selectively moveable between a first position and a second position.

4. The fabric piece conveying system of claim 1 wherein said holding means includes a plurality of clamps and a clamp actuator.

5. The fabric piece conveying system of claim 4 wherein said clamp actuator is selectively moveable between a first open position for releasing said fabric piece and a second closed position for securing said fabric piece.

6. The fabric piece conveying system of claim 1 wherein said binding conveyor includes:

(a) a support frame;

(b) at least one belt attached to said frame for transporting said fixture; and (c) drive means for driving said belt.

7. The fabric piece conveying system of claim 6 wherein said support frame is generally rectangular having four adjacent legs.

8. The fabric piece conveying system of claim 7 further including transfer means for transferring said fabric piece fixture from one leg of said rectangular support frame to an adjacent leg of said rectangular support frame.

9. The fabric piece conveying system of claim 8 wherein said transfer means includes:

(a) a lift for lifting said fabric piece fixture;

(b) at least one belt attached to said lift for transporting said fixture; and (c) drive means for driving said belt.

10. The fabric piece conveying system of claim 6 wherein said belt includes a primary belt for transporting said fabric piece fixture at one speed and a secondary belt for transporting said fabric piece fixture at a different speed.

11. The fabric piece conveying system of claim 10 further including a lift to lift said secondary belt above said primary belt such that said fabric piece fixture is supported and transported by said secondary belt.

12. The fabric piece conveying system of claim 1 wherein one of said work stations is a binding machine for applying binding to said fabric piece.

13. A fabric piece fixture for an apparatus for applying a binding to an edge of a fabric piece at a stationary work station, said fixture comprising:

(a) a base;

(b) a support attached to said base;

(c) fabric engaging means mounted on said support for engaging, positioning and securing said fabric piece, wherein said fabric engaging means includes: (i) clamping means attached to said support; (ii) adjustment means for adjusting said fabric piece to a plurality of horizontal and vertical positions when engaged; and (iii) actuator means for adjusting said adjustment means between said plurality of positions; and (d) an identification means including an encoded badge located on said fabric piece fixture.

14. The fabric piece fixture of claim 13 wherein said base is square shaped.

15. The fabric piece fixture of claim 13 wherein said fabric piece fixture further includes sensor means for determining the relative position of said fabric piece fixture to said apparatus.

16. The fabric piece fixture of claim 13 wherein said fabric piece fixture further includes bumper means.

17. The fabric piece fixture of claim 13 wherein said clamping means has a first opened position for receiving said fabric piece and a second closed position for securing said fabric piece, and wherein said clamping means includes actuator means for selectively moving said clamping means between said first open position and said second closed position.

18. The fabric piece fixture of claim 17 wherein said actuator means includes means for operatively receiving a clamp control means such that input from said clamp control means selectively determines the position, open or closed, of said clamping means.

19. The fabric piece fixture of claim 13 wherein said adjustment means includes means for adjusting the horizontal position of said fabric piece when the same is engaged.

20. The fabric piece fixture of claim 13 wherein said adjustment means includes means for adjusting the vertical position of said fabric piece when the same is engaged.

21. The fabric piece fixture of claim 13 wherein said adjustment means includes means for adjusting the angular position of said fabric piece when the same is engaged.

22. The fabric piece fixture of claim 13 wherein said adjustment means further includes means for operatively receiving an adjustment control means such that input from said adjustment control means selectively determines the position of said adjustment means.

23. The fabric piece fixture of claim 13 wherein said support includes a first post and a second post, and wherein said first post and said second post are independent and moveable relative to one another.

24. The fabric piece fixture of claim 23 wherein said adjustment means includes size adjustment means for adjusting the distance between said first post and said second post to adjust for different size fabric pieces.

25. The fabric piece fixture of claim 24 wherein said size adjustment means includes locking means for locking said first post and said second post into position relative to each other.

26. A fabric piece conveying system for applying a binding to an edge of a fabric piece, said apparatus comprising:

(a) a fabric piece fixture for holding said fabric piece, said fixture including: (i) a base; (ii) a support attached to said base; and (iii) fabric engaging means mounted on said support for engaging, positioning and securing said fabric piece;

(b) a conveyor for transporting said fabric piece fixture;

(c) at least one stationary work station having a supply of binding located adjacent to said conveyor for attaching said binding to said edge of said fabric piece while said fabric piece is being held by said fabric piece fixture; and (d) a transfer station for placing said fabric piece on said fabric piece fixture, wherein said transfer station includes transport means for transporting said fabric piece and holding means for holding said fabric piece, wherein said holding means is attached to said transport means.

27. The fabric piece conveying system of claim 26 wherein said transport means includes a housing fixture attached to said holding means and a housing fixture actuator for moving said housing fixture.

28. The fabric piece conveying system of claim 27 wherein said housing actuator is selectively moveable between a first position and a second position.

29. The fabric piece conveying system of claim 26 wherein said holding means includes a plurality of clamps and a clamp actuator.

30. The fabric piece conveying system of claim 29 wherein said clamp actuator is selectively moveable between a first open position for releasing said fabric piece and a second closed position for securing said fabric piece.

31. The fabric piece conveying system of claim 26 wherein said binding conveyor includes:

(a) a support frame;

(b) at least one belt attached to said frame for transporting said fixture; and (c) drive means for driving said belt.

32. The fabric piece conveying system of claim 31 wherein said support frame is generally rectangular having four adjacent legs.

33. The fabric piece conveying system of claim 32 further including transfer means for transferring said fabric piece fixture from one leg of said rectangular support frame to an adjacent leg of said rectangular support frame.

34. The fabric piece conveying system of claim 33 wherein said transfer means includes:

(a) a lift for lifting said fabric piece fixture;

(b) at least one belt attached to said lift for transporting said fixture; and (c) drive means for driving said belt.

35. The fabric piece conveying system of claim 31 wherein said belts includes a primary belt for transporting said fabric piece fixture at one speed and a secondary belt for transporting said fabric piece fixture at a different speed.

36. The fabric piece conveying system of claim 35 further including a lift to lift said secondary belt above said primary belt such that said fabric piece fixture is supported and transported by said secondary belt.

37. The fabric piece conveying system of claim 26 wherein one of said work stations is a binding machine for applying binding to said fabric piece.

38. The fabric piece conveying system of claim 26 wherein said base is square shaped.

39. The fabric piece conveying system of claim 26 wherein said fabric piece fixture further includes sensor means for determining the relative position of said fabric piece fixture to said conveyer.

40. The fabric piece conveying system of claim 26 wherein said fabric piece fixture further includes bumper means.

41. The fabric piece conveying system of claim 26 wherein said fabric piece fixture further includes identification means.

42. The fabric piece conveying system of claim 41 wherein said identification means includes an encoded badge located on said fabric piece fixture, and wherein said fabric piece conveying system further includes a scanning device for receiving messages from said encoded badge.

43. The fabric piece conveying system of claim 26 wherein said fabric engaging means includes:

(a) clamping means attached to said support; and (b) adjustment means for adjusting said fabric piece to a plurality of horizontal and vertical positions when engaged.

44. The fabric piece conveying system of claim 43 wherein said clamping means has a first opened position for receiving said fabric piece and a second closed position for securing said fabric piece, and wherein said clamping means includes actuator means for selectively moving said clamping means between said first open position and said second closed position.

45. The fabric piece conveying system of claim 44 wherein said actuator means includes means for operatively receiving a clamp control means such that input from said clamp control means selectively determines the position, open or closed, of said clamping means.

46. The fabric piece conveying system of claim 43 wherein said adjustment means includes means for adjusting the horizontal position of said fabric piece when the same is engaged.

47. The fabric piece conveying system of claim 43 wherein said adjustment means includes means for adjusting the vertical position of said fabric piece when the same is engaged.

48. The fabric piece conveying system of claim 43 wherein said adjustment means includes means for adjusting the angular position of said fabric piece when the same is engaged.

49. The fabric piece conveying system of claim 43 wherein said adjustment means includes actuator means for adjusting said adjustment means between a plurality of positions.

50. The fabric piece conveying system of claim 49 wherein said adjustment means further includes means for operatively receiving an adjustment control means such that input from said adjustment control means selectively determines the position of said adjustment means.

51. The fabric piece conveying system of claim 26 wherein said support includes a first post and a second post, and wherein said first post and said second post are independent and moveable relative to one another.

52. The fabric piece conveying system of claim 51 wherein said adjustment means includes size adjustment means for adjusting the distance between said first post and said second post to adjust for different size fabric pieces.

53. The fabric piece conveying system of claim 52 wherein said size adjustment means includes locking means for locking said first post and said second post into position relative to each other.

54. A fabric piece conveying system for applying a binding to an edge of a fabric piece, said apparatus comprising:

(a) a fabric piece fixture for holding said fabric piece;

(b) a conveyor for transporting said fabric piece fixture; and (c) at least one stationary work station having a supply of binding located adjacent to said conveyor for attaching said binding to said edge of said fabric piece while said fabric piece is being held by said fabric piece fixture, wherein said fabric piece conveyor includes: (i) a support frame; (ii) at least one belt attached to said frame for transporting said fixture; and (iii) drive means for driving said belt, wherein said support frame is generally rectangular having four adjacent legs and further including transfer means for transferring said fabric piece fixture from one leg of said rectangular support frame to an adjacent leg of said rectangular support frame.

55. The fabric piece conveying system of claim 54 further including a transfer station for placing said fabric piece on said fabric piece fixture.

56. The fabric piece conveying system of claim 55 wherein said transfer station includes transport means for transporting said fabric piece and holding means for holding said fabric piece, wherein said holding means is attached to said transport means.

57. The fabric piece conveying system of claim 56 wherein said transport means includes a housing fixture attached to said holding means and a housing fixture actuator for moving said housing fixture.

58. The fabric piece conveying system of claim 57 wherein said housing actuator is selectively moveable between a first position and a second position.

59. The fabric piece conveying system of claim 56 wherein said holding means includes a plurality of clamps and a clamp actuator.

60. The fabric piece conveying system of claim 59 wherein said clamp actuator is selectively moveable between a first open position for releasing said fabric piece and a second closed position for securing said fabric piece.

61. The fabric piece conveying system of claim 54 wherein said transfer means includes:

(a) a lift for lifting said fabric piece fixture;

(b) at least one belt attached to said lift for transporting said fixture; and (c) drive means for driving said belt.

62. The fabric piece conveying system of claim 54 wherein said belt includes a primary belt for transporting said fabric piece fixture at one speed and a secondary belt for transporting said fabric piece fixture at a different speed.

63. The fabric piece conveying system of claim 62 further including a lift to lift said secondary belt above said primary belt such that said fabric piece fixture is supported and transported by said secondary belt.

64. The fabric piece conveying system of claim 54 wherein one of said work stations is a binding machine for applying binding to said fabric piece.

65. A fabric piece conveying system for applying a binding to an edge of a fabric piece, said apparatus comprising:

(a) a fabric piece fixture for holding said fabric piece;

(b) a conveyor for transporting said fabric piece fixture; and (c) at least one stationary work station having a supply of binding located adjacent to said conveyor for attaching said binding to said edge of said fabric piece while said fabric piece is being held by said fabric piece fixture, wherein said fabric piece conveyor includes: (i) a support frame; (ii) at least one belt attached to said frame for transporting said fixture; and (iii) drive means for driving said belt wherein said belts includes a primary belt for transporting said fabric piece fixture at be speed and a secondary belt for transporting said fabric piece fixture at a different speed.

66. The fabric piece conveying system of claim 65 further including a transfer station for placing said fabric piece on said fabric piece fixture.

67. The fabric piece conveying system of claim 66 wherein said transfer station includes transport means for transporting said fabric piece and holding means for holding said fabric piece, wherein said holding means is attached to said transport means.

68. The fabric piece conveying system of claim 67 wherein said transport means includes a housing fixture attached to said holding means and a housing fixture actuator for moving said housing fixture.

69. The fabric piece conveying system of claim 68 wherein said housing actuator is selectively movable between a first position and a second position.

70. The fabric piece conveying system of claim 67 wherein said holding means includes a plurality of clamps and a clamp actuator.

71. The fabric piece conveying system of claim 70 wherein said clamp actuator is selectively moveable between a first open position for releasing said fabric piece and a second closed position for securing said fabric piece.

72. The fabric piece conveying system of claim 65 wherein said support frame is generally rectangular having four adjacent legs.

73. The fabric piece conveying system of claim 72 further including transfer means for transferring said fabric piece fixture from one leg of said rectangular support frame to an adjacent leg of said rectangular support frame.

74. The fabric piece conveying system of claim 73 wherein said transfer means includes:

(a) a lift for lifting said fabric piece fixture;

(b) at least one belt attached to said lift for transporting said fixture; and (c) drive means for driving said belt.

75. The fabric piece conveying system of claim 65 further including a lift to lift said secondary belt above said primary belt such that said fabric piece fixture is supported and transported by said secondary belt.

76. The fabric piece conveying system of claim 65 wherein one of said work stations is a binding machine for applying binding to said fabric piece.

77. A fabric piece conveying system for applying a binding to an edge of a fabric piece, said apparatus comprising:

(a) a fabric piece fixture for holding said fabric piece, said fixture including: (i) a base; (ii) a support attached to said base; and (iii) fabric engaging means mounted on said support for engaging, positioning and securing said fabric piece;

(b) a conveyor for transporting said fabric piece fixture, wherein said fabric piece conveyor includes: (i) a support frame; (ii) at least one belt attached to said frame for transporting said fixture; and (iii) drive means for driving said belt, wherein said support frame is generally rectangular having four adjacent legs and further including transfer means for transferring said fabric piece fixture from one leg of said rectangular support frame to an adjacent leg of said rectangular support frame;

(c) at least one stationary work station having a supply of binding located adjacent to said conveyor for attaching said binding to said edge of said fabric piece while said fabric piece is being held by said fabric piece fixture; and (d) a transfer station for placing said fabric piece on said fabric piece fixture.

78. The fabric piece conveying system of claim 77 wherein said transfer station includes transport means for transporting said fabric piece and holding means for holding said fabric piece, wherein said holding means is attached to said transport means.

79. The fabric piece conveying system of claim 78 wherein said transport means includes a housing fixture attached to said holding means and a housing fixture actuator for moving said housing fixture.

80. The fabric piece conveying system of claim 79 wherein said housing actuator is selectively moveable between a first position and a second position.

81. The fabric piece conveying system of claim 78 wherein said holding means includes a plurality of clamps and a clamp actuator.

82. The fabric piece conveying system of claim 81 wherein said clamp actuator is selectively moveable between a first open position for releasing said fabric piece and a second closed position for securing said fabric piece.

83. The fabric piece conveying system of claim 77 wherein said transfer means includes:

(a) a lift for lifting said fabric piece fixture;

(b) at least one belt attached to said lift for transporting said fixture; and (c) drive means for driving said belt.

84. The fabric piece conveying system of claim 83 wherein said belts includes a primary belt for transporting said fabric piece fixture at one speed and a secondary belt for transporting said fabric piece fixture at a different speed.

85. The fabric piece conveying system of claim 84 further including a lift to lift said secondary belt above said primary belt such that said fabric piece fixture is supported and transported by said secondary belt.

86. The fabric piece conveying system of claim 77 wherein one of said work stations is a binding machine for applying binding to said fabric piece.

87. The fabric piece conveying system of claim 77 wherein said base is square shaped.

88. The fabric piece conveying system of claim 77 wherein said fabric piece fixture further includes sensor means for determining the relative position of said fabric piece fixture to said conveyor.

89. The fabric piece conveying system of claim 77 wherein said fabric piece fixture further includes bumper means.

90. The fabric piece conveying system of claim 77 wherein said fabric piece fixture further includes identification means.

91. The fabric piece conveying system of claim 90 wherein said identification means includes an encoded badge located on said fabric piece fixture, and wherein said fabric piece conveying system further includes a scanning device for receiving messages from said encoded badge.

92. The fabric piece conveying system of claim 77 wherein said fabric engaging means includes:

(a) clamping means attached to said support; and (b) adjustment means for adjusting said fabric piece to a plurality of horizontal and vertical positions when engaged.

93. The fabric piece conveying system of claim 92 wherein said clamping means has a first opened position for receiving said fabric piece and a second closed position for securing said fabric piece, and wherein said clamping means includes actuator means for selectively moving said clamping means between said first open position and said second closed position.

94. The fabric piece conveying system of claim 93 wherein said actuator means includes means for operatively receiving a clamp control means such that input from said clamp control means selectively determines the position, open or closed, of said clamping means.

95. The fabric piece conveying system of claim 92 wherein said adjustment means includes means for adjusting the horizontal position of said fabric piece when the same is engaged.

96. The fabric piece conveying system of claim 92 wherein said adjustment means includes means for adjusting the vertical position of said fabric piece when the same is engaged.

97. The fabric piece conveying system of claim 92 wherein said adjustment means includes means for adjusting the angular position of said fabric piece when the same is engaged.

98. The fabric piece conveying system of claim 92 wherein said same adjustment means includes actuator means for adjusting said adjustment means between a plurality of positions.

99. The fabric piece conveying system of claim 98 wherein said adjustment means further includes means for operatively receiving an adjustment control means such that input from said adjustment control means selectively determines the position of said adjustment means.

100. The fabric piece conveying system of claim 77 wherein said support includes a first post and a second post, and wherein said first post and said second post are independent and moveable relative to one another.

101. The fabric piece conveying system of claim 100 wherein said adjustment means includes size adjustment means for adjusting the distance between said first post and said second post to adjust for different size fabric pieces.

102. The fabric piece conveying system of claim 101 wherein said size adjustment means includes locking means for locking said first post and said second post into position relative to each other.

* * * * *